US010690348B2

(12) United States Patent
Moura et al.

(10) Patent No.: US 10,690,348 B2
(45) Date of Patent: Jun. 23, 2020

(54) TURBINE ENGINE COMBUSTOR HEAT SHIELD WITH ONE OR MORE COOLING ELEMENTS

(71) Applicant: United Technologies Corporation, Farmington, CT (US)

(72) Inventors: Dennis M. Moura, South Windsor, CT (US); Monica Pacheco-Tougas, Waltham, MA (US); Jonathan J. Eastwood, Newington, CT (US); Lee E. Bouldin, Woodbridge, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 519 days.

(21) Appl. No.: 15/032,080

(22) PCT Filed: Nov. 4, 2014

(86) PCT No.: PCT/US2014/063849

§ 371 (c)(1),
(2) Date: Apr. 26, 2016

(87) PCT Pub. No.: WO2015/112220

PCT Pub. Date: Jul. 30, 2015

(65) Prior Publication Data

US 2016/0258626 A1 Sep. 8, 2016

Related U.S. Application Data

(60) Provisional application No. 61/899,532, filed on Nov. 4, 2013.

(51) Int. Cl.
*F23R 3/06* (2006.01)
*F23R 3/60* (2006.01)
(Continued)

(52) U.S. Cl.
CPC ..... *F23R 3/06* (2013.01); *F23R 3/002* (2013.01); *F23R 3/005* (2013.01); *F23R 3/007* (2013.01);
(Continued)

(58) Field of Classification Search
CPC .... F23R 3/06; F23R 3/002; F23R 3/60; F23R 2900/03041–03045; F28F 13/12; F28F 3/022; F28F 3/02; F28F 3/048
See application file for complete search history.

(56) References Cited

U.S. PATENT DOCUMENTS 5,363,643 A * 11/1994 Halila ..... F23R 3/002 60/752
2002/0108375 A1* 8/2002 Johnson ..... F23R 3/002 60/772
(Continued)

FOREIGN PATENT DOCUMENTS

GB 2356042 5/2001

OTHER PUBLICATIONS

Extended EP Search Report dated Sep. 26, 2016.

*Primary Examiner* — Andrew H Nguyen
(74) *Attorney, Agent, or Firm* — Getz Balich LLC

(57) ABSTRACT

A combustor wall is provided for a turbine engine. The combustor wall includes a shell and a heat shield that is attacked to the shell. The heat shield includes a rail and a cooling element connected to the rail in a cavity. The cavity extends in a vertical direction between the shell and the heat shield. The cavity fluidly couples a plurality of apertures in the shell with a plurality of apertures in the heat shield.

13 Claims, 10 Drawing Sheets

(51) Int. Cl.
*F23R 3/00* (2006.01)
*F23R 3/50* (2006.01)

(52) U.S. Cl.
CPC ..... *F23R 3/50* (2013.01); *F23R 3/60* (2013.01); *F23R 2900/00017* (2013.01); *F23R 2900/03041* (2013.01); *F23R 2900/03042* (2013.01); *F23R 2900/03044* (2013.01); *F23R 2900/03045* (2013.01)

(56) References Cited

U.S. PATENT DOCUMENTS

2002/0124572 A1* 9/2002 Pidcock ..... F23R 3/002 60/796
2003/0101731 A1* 6/2003 Burd ..... F23M 5/02 60/796
2003/0213250 A1* 11/2003 Pacheco-Tougas ..... F23R 3/002 60/752
2005/0047932 A1* 3/2005 Nakae ..... F23R 3/002 417/313
2008/0264064 A1* 10/2008 Sze ..... F23R 3/002 60/752
2008/0264065 A1* 10/2008 Gerendas ..... F23R 3/002 60/754
2010/0095679 A1* 4/2010 Rudrapatna ..... F23R 3/005 60/752
2010/0223931 A1* 9/2010 Chila ..... F23R 3/005 60/760
2010/0229564 A1* 9/2010 Chila ..... F23R 3/06 60/752
2010/0263386 A1* 10/2010 Edwards ..... F23R 3/002 60/796
2012/0255311 A1 10/2012 Miyake
2013/0192233 A1 8/2013 Eastwood et al.
2014/0290256 A1 10/2014 Fujimoto et al.

* cited by examiner

TURBINE ENGINE COMBUSTOR HEAT SHIELD WITH ONE OR MORE COOLING ELEMENTS

CROSS-REFERENCE TO RELATED APPLICATION

This application claims priority to PCT Patent Application No. PCT/US14/063849 filed Nov. 4, 2014, which claims priority to U.S. Provisional Patent Appln. No. 61/899,532 filed Nov. 4, 2013, which are hereby incorporated herein by reference in their entireties.

BACKGROUND OF THE INVENTION

1. Technical Field

This disclosure relates generally to a turbine engine and, more particularly, to a combustor for a turbine engine.

2. Background Information

A floating wall combustor for a turbine engine typically includes a bulkhead that extends radially between inner and outer combustor walls. Each of the combustor walls includes a shell and a heat shield, which defines a radial side of a combustion chamber. Cooling cavities extend radially between the heat shield and the shell. These cooling cavities fluidly couple impingement apertures in the shell with effusion apertures in the heat shield.

The heat shield is typically formed from a plurality of heat shield panels. Each of these panels may include a base and a plurality of rails. The rails extend radially from the base to the shell, thereby defining axial and circumferential ends of the cooling cavities.

There is a need in the art for improved turbine engine combustors and localized cooling which reduces thermal induced stresses in heat shield panels.

SUMMARY OF THE DISCLOSURE

According to an aspect of the invention, a combustor wall is provided for a turbine engine. The combustor wall includes a shell and a heat shield, which is attached to the shell. The heat shield includes a rail and a cooling element connected to the rail in a cavity. The cavity extends in a vertical direction between the shell and the heat shield. The cavity fluidly couples a plurality of apertures in the shell with a plurality of apertures in the heat shield.

According to another aspect of the invention, another combustor is provided for a turbine engine that includes a combustor wall. The combustor wall includes a shell and a heat shield, which is attached to the shell. The heat shield includes a base, a protrusion and a cooling element. The protrusion extends vertically out from the base. The cooling element is connected to the protrusion within a cooling cavity of the combustor wall. The protrusion has a vertical height. The cooling element has a vertical height that is less than the vertical height of the protrusion.

According to another aspect of the invention, a combustor wall is provided for a turbine engine. The combustor wall includes a shell and a heat shield, which is attached to the shell. The heat shield includes a rail and a cooling element connected to the rail in a cavity. The cavity extends between the shell and the heat shield. The cavity fluidly couples a plurality of apertures in the shell with a plurality of apertures in the heat shield. At least one of the apertures in the heat shield extends through the cooling element.

The cooling cavity may extend vertically between the shell and the heat shield. The cooling cavity may also or alternatively fluidly couple a plurality of apertures (e.g., impingement apertures) in the shell with a plurality of apertures (e.g., effusion apertures) in the heat shield.

The protrusion may be configured as or otherwise include a rail.

The protrusion may be configured as or otherwise include at least a portion of an attachment that attaches the heat shield to the shell; e.g., a stud.

The protrusion may be configured as or otherwise include a boss.

The protrusion (e.g., the rail) may have a vertical height. The vertical height of the cooling element may be less than about seventy-five percent of the vertical height of the protrusion.

The protrusion (e.g., the rail) may have a thickness. The cooling element may have a thickness that is greater than about one hundred percent of the thickness of the protrusion. The thicknesses may be measured in a direction that is substantially perpendicular to the vertical direction.

The cooling element may have a length that is between about two and about three times greater than a width of one of the apertures in the shell. The length and the width may be measured in a direction that is substantially perpendicular to the vertical direction.

The heat shield may include a base (e.g., a panel base). The rail and the cooling element may be connected to the base. Alternatively, the cooling element may be vertically separated from the base by a spatial gap; e.g., an air gap.

The cooling element may be one of a plurality of cooling elements that are arranged along and connected to the protrusion (e.g., the rail).

The cooling elements may include a first element and a second element. The second element may be separated from the first element by a gap; e.g., an air gap. At least one of the apertures in the heat shield may be located at (e.g., on, adjacent or proximate) the spatial gap.

The cooling elements may include a first element and a second element. The second element may be contiguous with the first element.

The cooling elements may include a first element and a second element. The second element may have a different configuration than the first element.

The cooling elements may include a first element and a second element. The second element may have a substantially identical configuration as the first element.

At least one of the apertures in the heat shield may extend through the cooling element.

The heat shield may include a panel having a downstream end. The rail and the cooling element may be attached to the panel with the rail located at the downstream end.

The foregoing features and the operation of the invention will become more apparent in light of the following description and the accompanying drawings.

DETAILED DESCRIPTION OF THE INVENTION

Figure 1:
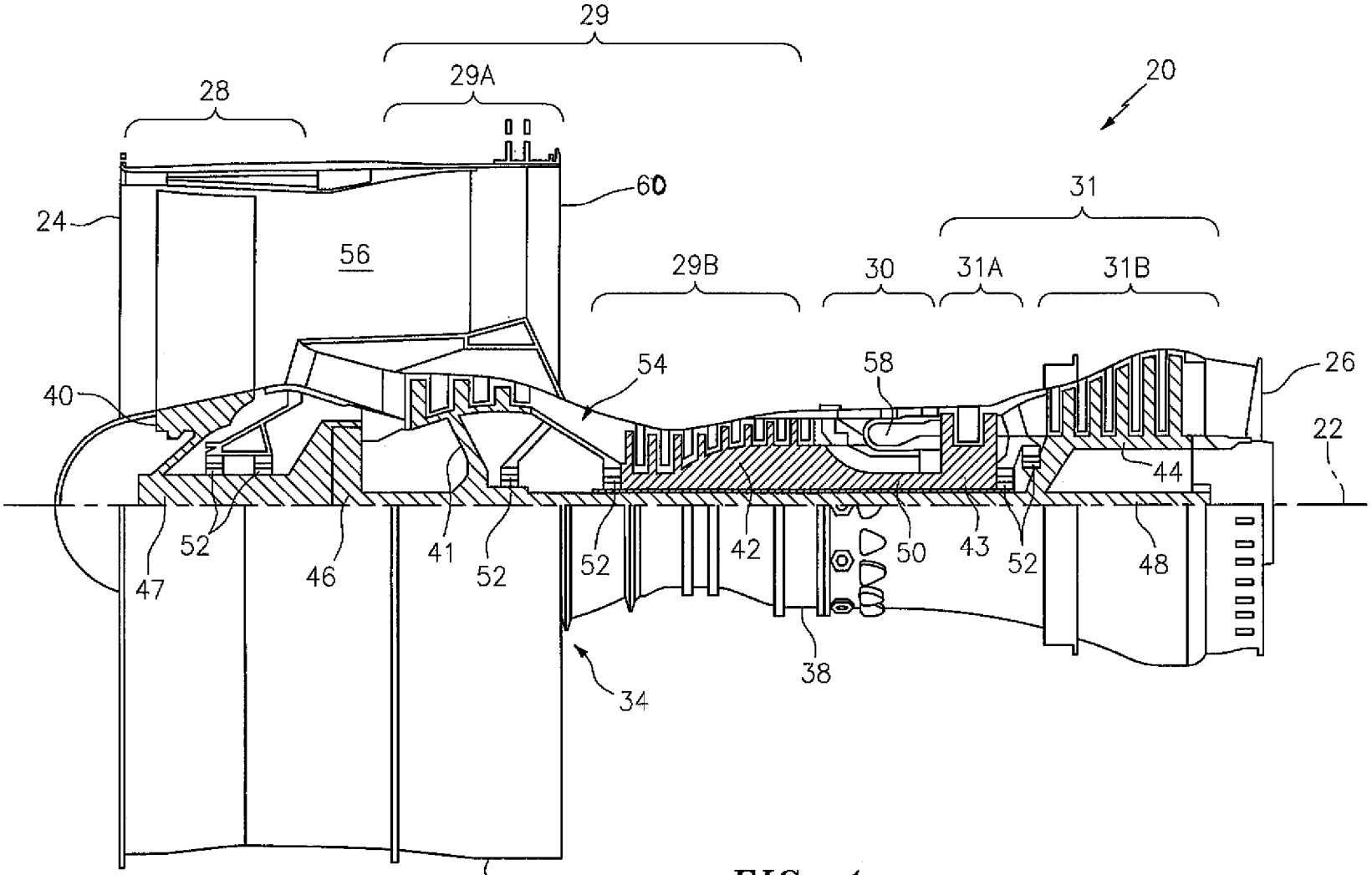
FIG. 1 is a side cutaway illustration of a geared turbine engine.

FIG. 1 is a side cutaway illustration of a geared turbine engine 20. This turbine engine 20 extends along an axial centerline 22 between an upstream airflow inlet 24 and a downstream airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-31 are arranged sequentially along the centerline 22 within an engine housing 34, which includes a first engine case 36 (e.g., a fan nacelle) and a second engine case 38 (e.g., a core nacelle).

Each of the engine sections 28, 29A, 29B, 31A and 31B includes a respective rotor 40-44. Each of the rotors 40-44 includes a plurality of rotor blades arranged circumferentially around and connected to (e.g., formed integral with or mechanically fastened, welded, brazed, adhered or otherwise attached to) one or more respective rotor disks. The fan rotor 40 is connected to a gear train 46 (e.g., an epicyclic gear train) through a shaft 47. The gear train 46 and the LPC rotor 41 are connected to and driven by the LPT rotor 44 through a low speed shaft 48. The HPC rotor 42 is connected to and driven by the HPT rotor 43 through a high speed shaft 50. The shafts 47, 48 and 50 are rotatably supported by a plurality of bearings 52. Each of the bearings 52 is connected to the second engine case 38 by at least one stator element such as, for example, an annular support strut.

Air enters the turbine engine 20 through the airflow inlet 24, and is directed through the fan section 28 and into an annular core gas path 54 and an annular bypass gas path 56. The air within the core gas path 54 may be referred to as "core air". The air within the bypass gas path 56 may be referred to as "bypass air".

The core air is directed through the engine sections 29-31 and exits the turbine engine 20 through the airflow exhaust 26. Within the combustor section 30, fuel is injected into an annular combustion chamber 58 and mixed with the core air. This fuel-core air mixture is ignited to power the turbine engine 20 and provide forward engine thrust. The bypass air is directed through the bypass gas path 56 and out of the turbine engine 20 through a bypass nozzle 60 to provide additional forward engine thrust. Alternatively, the bypass air may be directed out of the turbine engine 20 through a thrust reverser to provide reverse engine thrust.

Figure 2:
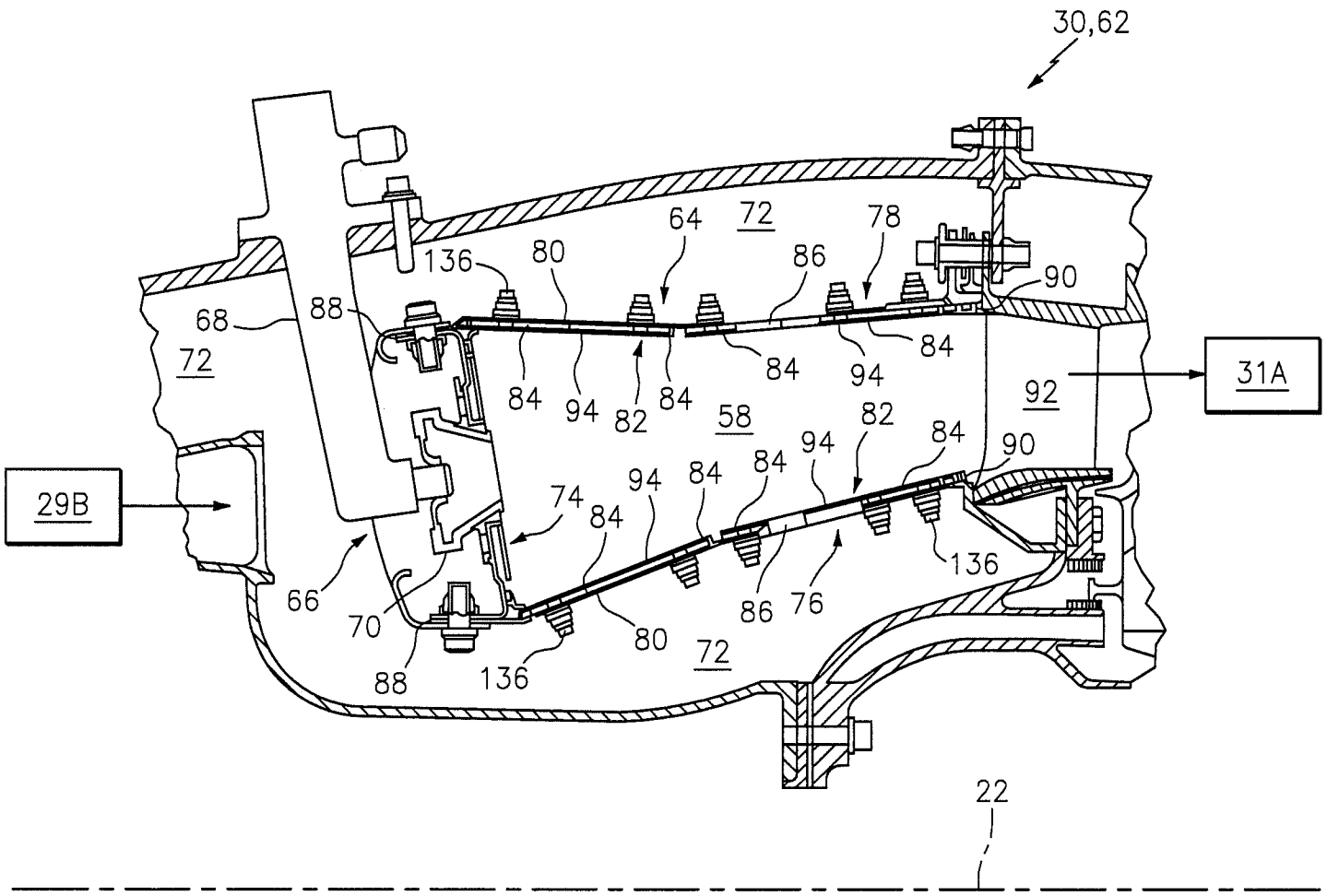
FIG. 2 is a side cutaway illustration of a portion of a combustor section.

FIG. 2 illustrates an assembly 62 of the turbine engine 20. This turbine engine assembly 62 includes a combustor 64. The turbine engine assembly 62 also includes one or more fuel injector assemblies 66, each of which may include a fuel injector 68 mated with a swirler 70.

Figure 3:
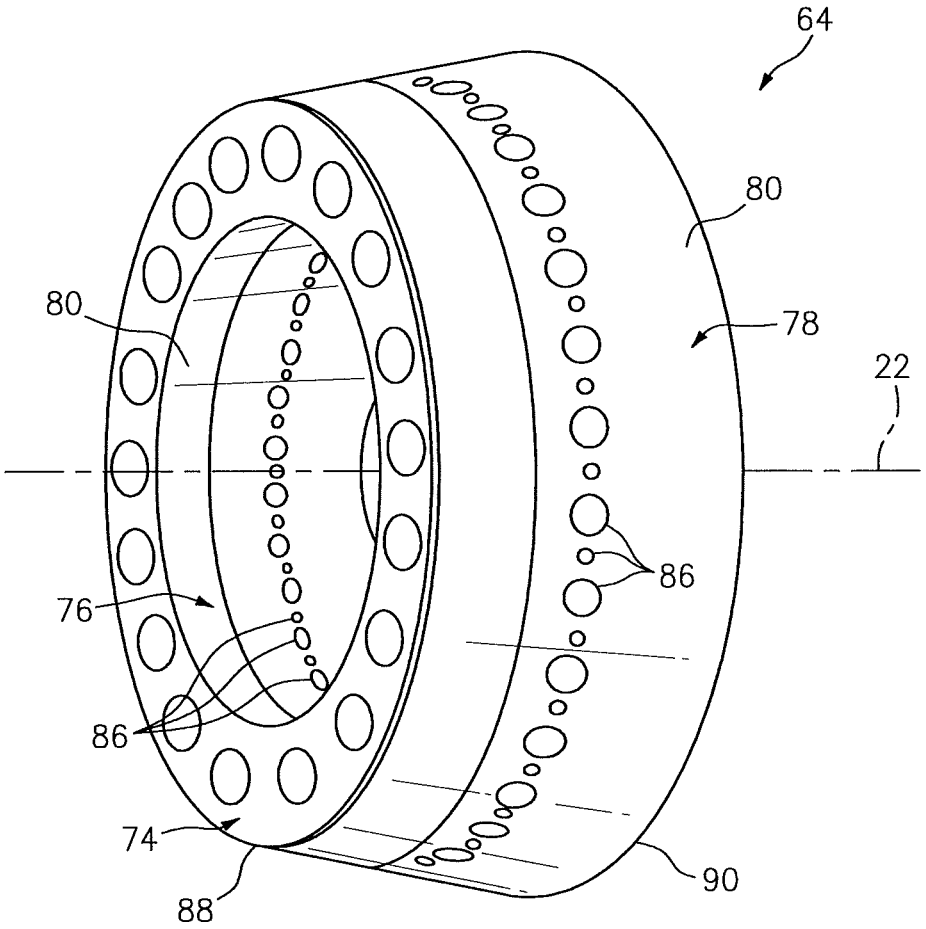
FIG. 3 is a perspective illustration of a portion of a combustor.

The combustor 64 may be configured as an annular floating wall combustor, which may be arranged within an annular plenum 72 of the combustor section 30. The combustor 64 of FIGS. 2 and 3, for example, includes an annular combustor bulkhead 74, a tubular combustor inner wall 76, and a tubular combustor outer wall 78. The bulkhead 74 extends radially between and is connected to the inner wall 76 and the outer wall 78. The inner wall 76 and the outer wall 78 each extends axially along the centerline 22 from the bulkhead 74 towards the turbine section 31A, thereby defining the combustion chamber 58.

Referring to FIG. 2, the inner wall 76 and the outer wall 78 may each have a multi-walled structure; e.g., a hollow dual-walled structure. The inner wall 76 and the outer wall 78 of FIG. 2, for example, each includes a tubular combustor shell 80 and a tubular combustor heat shield 82. The inner wall 76 and the outer wall 78 also each includes one or more cooling cavities 84 (e.g., impingement cavities) and one or more quench apertures 86, which are arranged circumferentially around the centerline 22.

The shell 80 extends circumferentially around the centerline 22. The shell 80 extends axially along the centerline 22 between an upstream end 88 and a downstream end 90. The shell 80 is connected to the bulkhead 74 at the upstream end 88. The shell 80 may be connected to a stator vane assembly 92 or the HPT section 31A at the downstream end 90.

The heat shield 82 extends circumferentially around the centerline 22. The heat shield 82 extends axially along the centerline 22 between an upstream end and a downstream end. The heat shield 82 may include one or more heat shield panels 94. These panels 94 may be arranged into one or more axial sets. The axial sets are arranged at discrete locations along the centerline 22. The panels 94 in each set are disposed circumferentially around the centerline 22 and form a hoop. Alternatively, the heat shield 82 may be configured from one or more tubular bodies.

Figure 4:
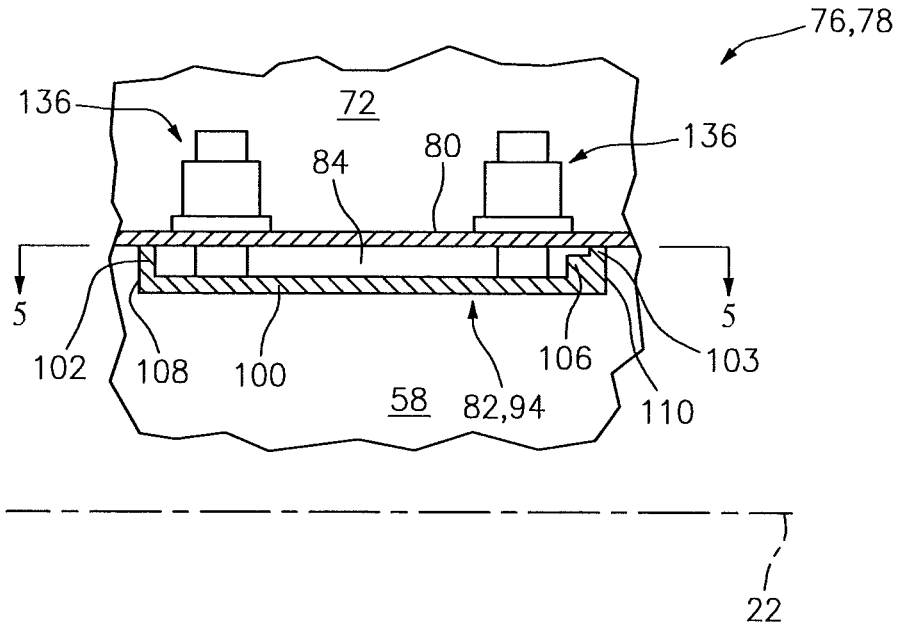
FIG. 4 is a side sectional illustration of a portion of a combustor wall.
Figure 5:
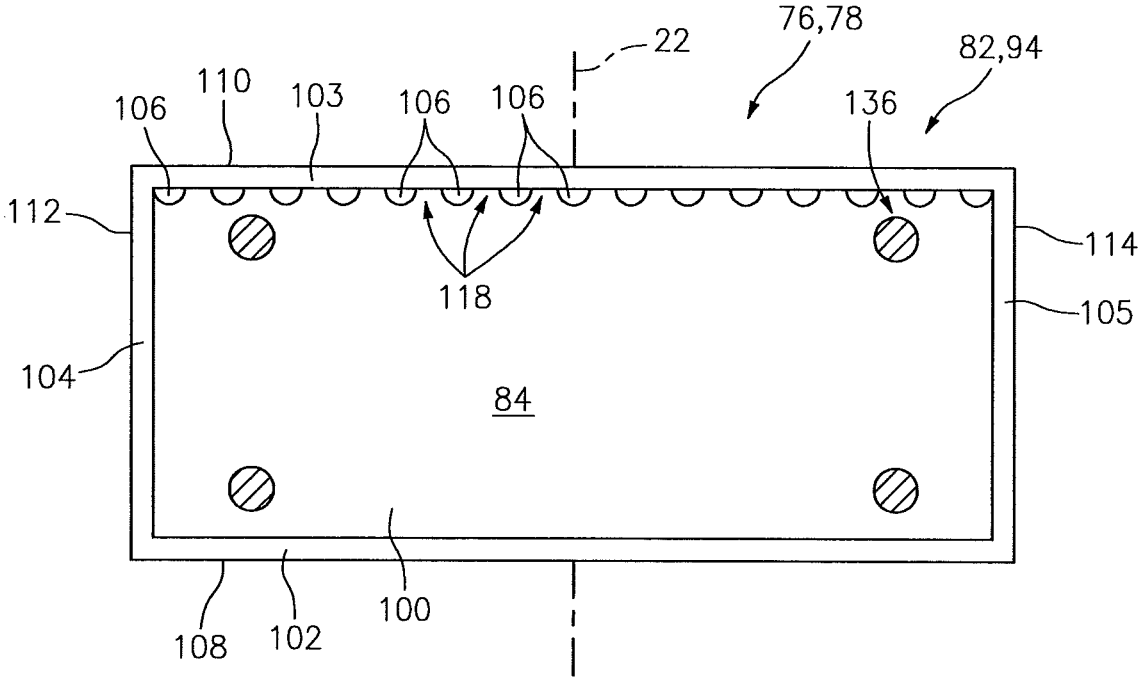
FIG. 5 is a sectional illustration of the portion of the combustor wall of FIG. 4.

FIGS. 4 and 5 illustrate exemplary portions of one of the walls 76, 78. It should be noted that the shell 80 and the heat shield 82 each respectively include one or more cooling apertures 96 and 98 (see FIG. 6) as described below in further detail. For ease of illustration, however, the shell 80 and the heat shield 82 of FIGS. 4 and 5 are shown without the cooling apertures 96 and 98.

Each of the panels 94 includes a panel base 100 and one or more panel rails (e.g., rails 102-105). One or more of the panels 94 also each includes one or more cooling elements 106.

The panel base 100 may be configured as a generally curved (e.g., arcuate) plate. The panel base 100 extends axially between an upstream axial end 108 and a downstream axial end 110. The panel base 100 extends circumferentially between opposing circumferential ends 112 and 114.

The panel rails may include one or more circumferentially extending end rails 102 and 103 and one more axially extending end rails 104 and 105. Each of the foregoing rails 102-105 extends radially out from (or in from) the panel base 100 relative to axis 22. The rail 102 is arranged at (e.g., on, adjacent or proximate) the axial end 108. The rail 103 is arranged at the axial end 110. The rails 104 and 105 extend axially between and are connected to the rails 102 and 103. The rail 104 is arranged at the circumferential end 112. The rail 105 is arranged at the circumferential end 114.

Figure 7:
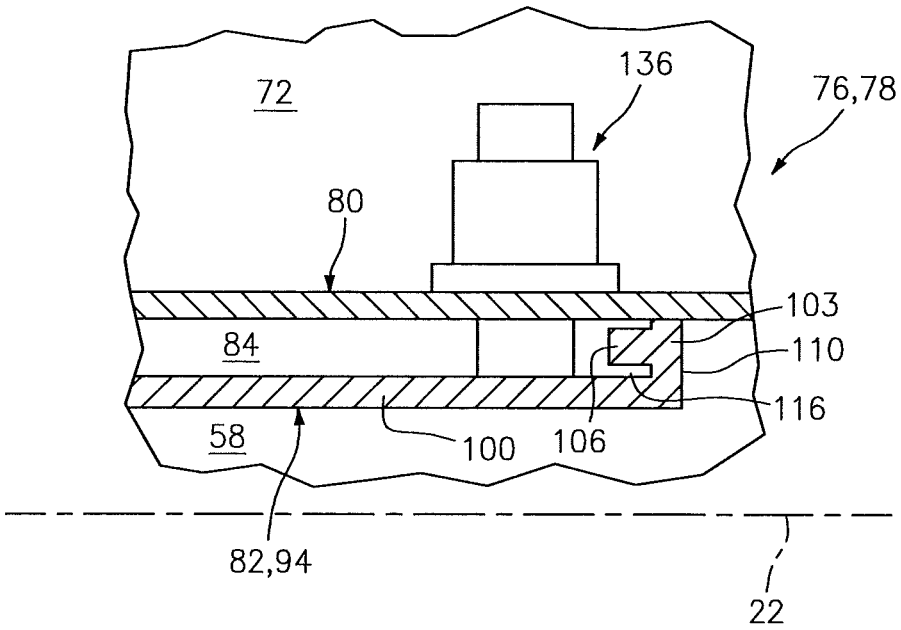
FIG. 7 is side sectional illustration of a portion of an alternate embodiment of a combustor wall.

One or more of the cooling elements 106 are formed integral with or attached to at least one of the rails 102-105. The cooling elements 106 of FIGS. 4 and 5, for example, are connected to the rail 103. One or more of the cooling elements 106 may also be formed integral with or attached to the panel base 100. Alternatively, referring to FIG. 7, one or more of the cooling elements 106 may each be separated from the panel base 100 by a spatial gap 116; e.g., an air gap.

Figure 8:
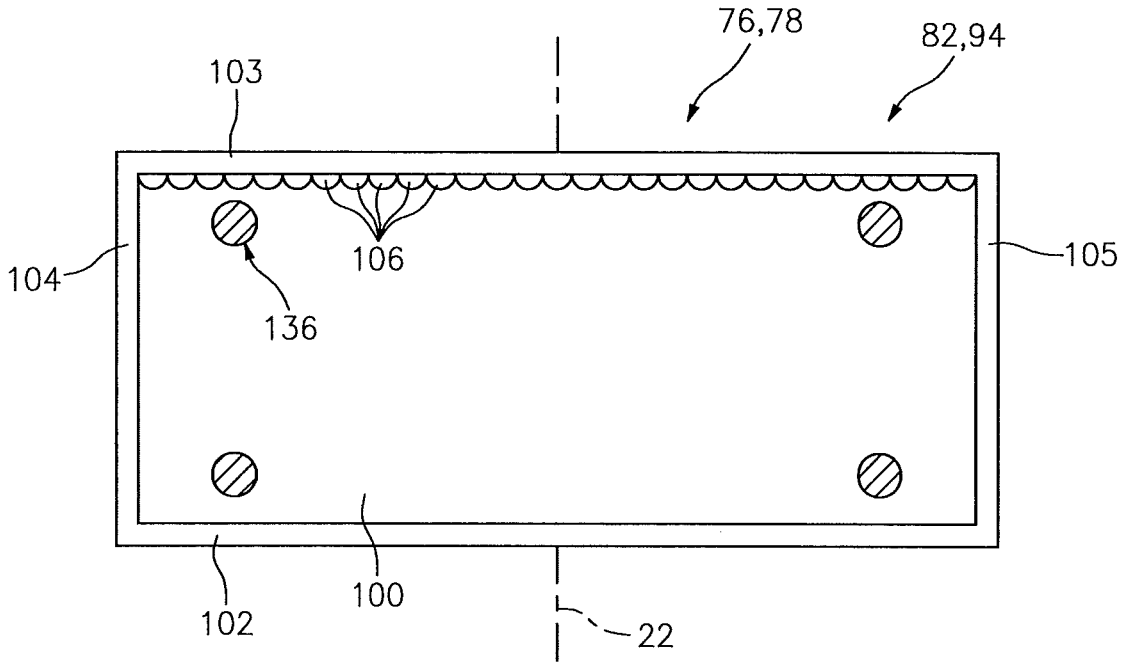
FIG. 8 is a sectional illustration of a portion of an alternate embodiment of a combustor wall.

Referring to FIG. 5, the cooling elements 106 are arranged within a respective one of the cooling cavities 84 at discrete locations along the rail 103. Adjacent cooling elements 106, for example, may be separated by a spatial gap 118; e.g., an air gap. Alternatively, referring to FIG. 8, one or more of the cooling elements 106 may be contiguous with (e.g., contact) one or more adjacent cooling elements 106.

Referring to FIG. 5, each of the cooling elements 106 has a parti-circular (e.g., semi-circular) cross-sectional geometry. Alternatively, one or more of the cooling elements 106 may each have a parti-elongated circular (e.g., oval or elliptical) cross-sectional geometry, a polygonal (e.g., square, rectangular or triangular) cross-sectional geometry, or any other type of cross-sectional geometry.

Figure 9:
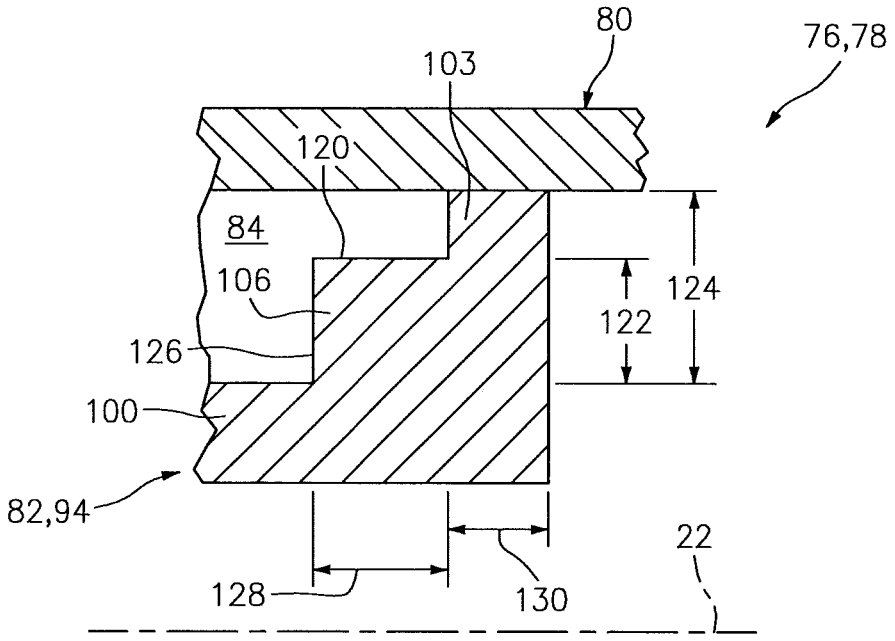
FIG. 9 is another side sectional illustration of a portion of the combustor wall of FIG. 4.

Referring to FIG. 9, each cooling element 106 extends vertically (e.g., radially) out from the panel base 100 to a distal end 120, thereby defining a vertical height 122. The height 122 of each cooling element 106 may be less than or substantially equal to about seventy-five percent (75%) of a vertical height 124 of the rail 103 as measured, for example, at (e.g., on, adjacent or proximate) a point where the cooling element 106 is connected to the rail 103. The height 122 of FIG. 9, for example, is substantially equal to between about two-thirds (⅔) and about one-half (½) the height 124. Alternatively, the height 122 of one or more of the cooling elements 106 may be greater than about seventy-five percent (75%) of the height 124; e.g., substantially equal to the height 124.

Each cooling element 106 extends laterally (e.g., axially) out from the rail 103 to a distal end 126, thereby defining a lateral thickness 128. The thickness 128 of each cooling element 106 may be greater than or substantially equal to about one hundred percent (100%) of a lateral thickness 130 of the rail 103 as measured, for example, at the point where the cooling element 106 is connected to the rail 103. The thickness 128 of FIG. 9, for example, is substantially equal to (or more than) about two hundred percent (200%) of the thickness 130. Alternatively, the thickness 128 of one or more of the cooling elements 106 may be less than about one hundred percent (100%) of the thickness 130.

Figure 6:
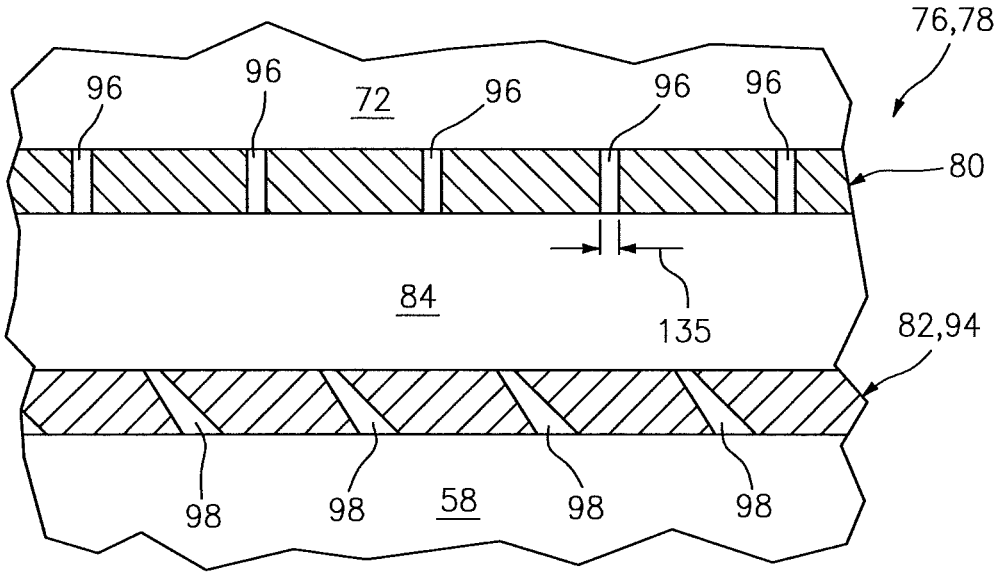
FIG. 6 is a side sectional illustration of a portion of a combustor wall.
Figure 10:
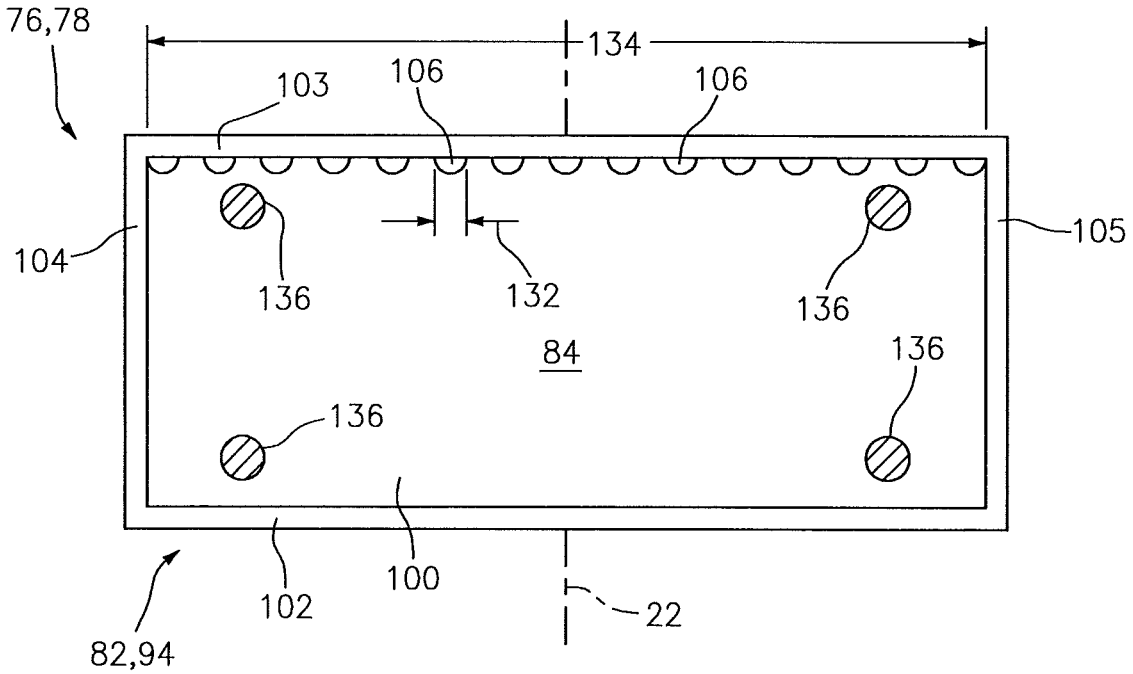
FIG. 10 is another sectional illustration of a portion of the combustor wall of FIG. 5.

Referring to FIG. 10, each cooling element 106 extends lengthwise (e.g., circumferentially) along the rail 103 between opposing ends, thereby defining a longitudinal length 132. The length 132 of each cooling element 106 may be less than or substantially equal to about twenty percent (20%) of a length 134 of the rail 103 as measured, for example, between the rails 104 and 105. The length 132 of FIG. 10, for example, is substantially equal to (or less than) about five percent (5%) of the length 134. Alternatively, the length 132 of at least one of the cooling elements 106 may be greater than about twenty percent (20%) of the length 134; e.g., between about fifty percent (50%) and about one hundred percent (100%) of the length 134. Referring to FIGS. 6 and 10, the length 132 may also or alternatively be sized relative to a width (e.g., a diameter) of one of the cooling apertures 96 (or apertures 98) proximate thereto. The length 132, for example, may be between about two times (2×) and about three times (3×) greater than the width 135 of each cooling aperture 96. The present invention, however, is not limited to the foregoing cooling element sizes.

Referring to FIG. 2, the heat shield 82 of the inner wall 76 circumscribes the shell 80 of the inner wall 76, and defines an inner side of the combustion chamber 58. The heat shield 82 of the outer wall 78 is arranged radially within the shell 80 of the outer wall 78, and defines an outer side of the combustion chamber 58.

Each heat shield 82 and, more particularly, each of the panels 94 may be respectively attached to the shell 80 by a plurality of mechanical attachments 136 (see also FIG. 4). The shells 80 and the heat shields 82 thereby respectively form the cooling cavities 84 in the inner and the outer walls 76, 78.

Referring to FIGS. 4 and 5, each cooling cavity 84 may extend circumferentially between the rails 104 and 105 of a respective one of the panels 94. Each cooling cavity 84 may extend axially between the rails 102 and 103 of a respective one of the panels 94. Each cooling cavity 84 extends radially between the shell 80 and the panel base 100 of a respective one of the panels 94.

Referring to FIG. 6, each cooling cavity 84 may fluidly couple one or more of the cooling apertures 96 in the shell 80 with one or more of the cooling apertures 98 in the heat shield 82. One or more of the cooling apertures 96 may each be configured as an impingement aperture. One or more of the cooling apertures 98 may each be configured as an effusion aperture.

During turbine engine operation, core air from the plenum 72 is directed into each cooling cavity 84 through respective cooling apertures 96. This core air (e.g., cooling air) may impinge against the panel base 100, thereby impingement cooling the heat shield 82. Referring to FIGS. 4 and 5, some of the core air within each cooling cavity 84 may flow over and/or between the one or more of the cooling elements 106, thereby convectively cooling a portion of the panel base 100 and/or at least a portion of the rail 103. In this manner, the cooling elements 106 may increase cooling of the rail 103 and/or the panel base 100 proximate the rail 103. Notably, without these cooling elements 106, a region of the panel base 100 under and proximate the rail 103 may be subject to higher temperatures than exposed regions of the panel base 100. The cooling elements 106 therefore may reduce thermally induced stresses within and erosion of the panel base 100 proximate the rail 103.

Referring again to FIG. 6, the core air within each cooling cavity 84 is subsequently directed through respective cooling apertures 98 and into the combustion chamber 58, thereby film cooling a downstream portion of the heat shield 82. Within each cooling aperture 98, the core air may also cool the heat shield 82 through convective heat transfer.

Figure 11:
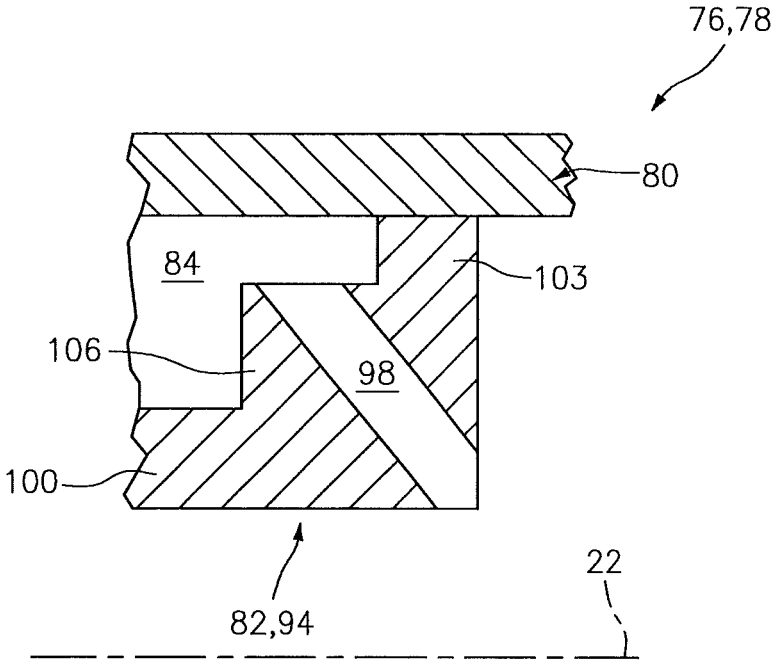
FIG. 11 is a side sectional illustration of a portion of an alternate embodiment of a combustor wall.

In some embodiments, referring to FIG. 11, at least one of the cooling apertures 98 may extend through a respective one of the cooling elements 106. This cooling aperture 98 may subsequently extend through the panel base 100 and/or the rail 103.

Figure 12:
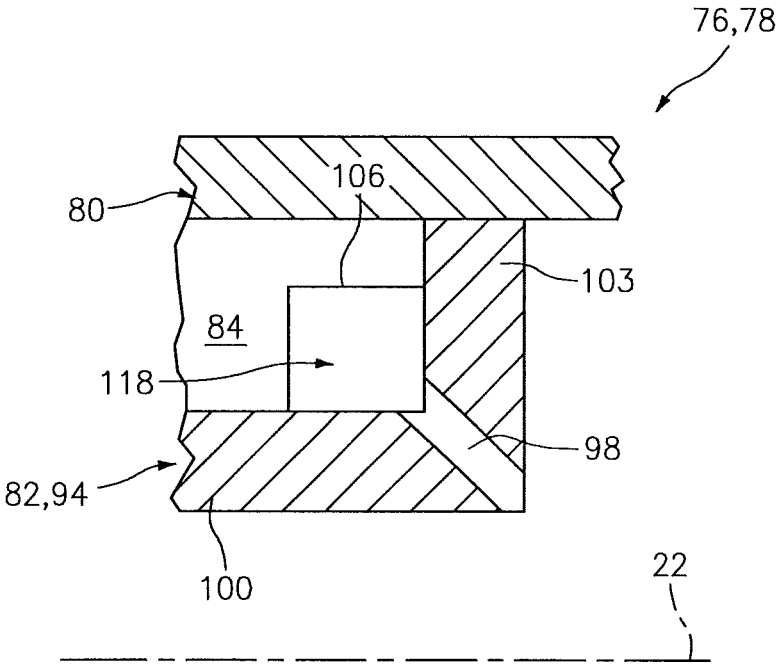
FIG. 12 is a side sectional illustration of a portion of an alternate embodiment of a combustor wall.

In some embodiments, referring to FIG. 12, at least one of the cooling apertures 98 may be located at the spatial gap 118 between an adjacent pair of the cooling elements 106. This cooling aperture 98 may extend through the panel base 100 and/or the rail 103.

In some embodiments, a first of the cooling elements 106 may have a different configuration than a second of the cooling elements 106. The first of the cooling elements 106, for example, may have a different cross-sectional geometry than the second of the cooling elements 106. The first of the cooling elements 106 may also or alternatively have a different height 122, thickness 128 and/or length 132 than the second of the cooling elements 106. Alternatively, each of the cooling elements 106 of a respective panel 94 may have substantially identical configurations.

In some embodiments, at least one of the cooling elements 106 may be connected to a plurality of the rails 102-105. One of the cooling elements 106, for example, may be connected to two of the rails (e.g., the rails 103 and 104, or the rails 104 and 105) at a corner therebetween.

Figure 13:
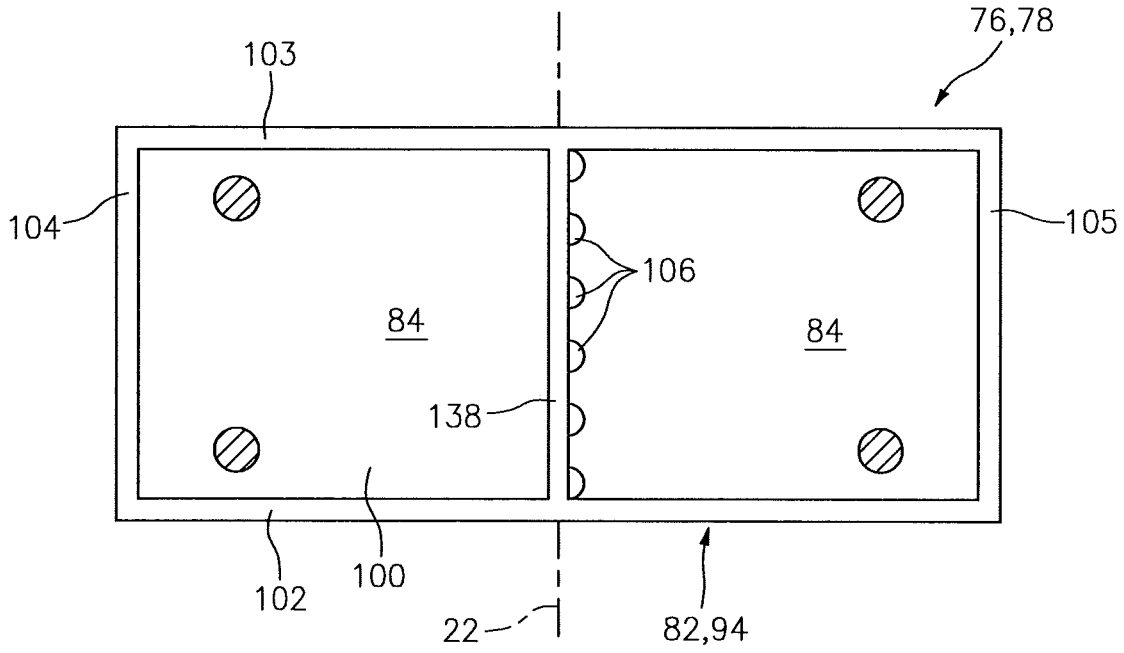
FIG. 13 is a sectional illustration of a portion of an alternate embodiment of a combustor wall.
Figure 14:
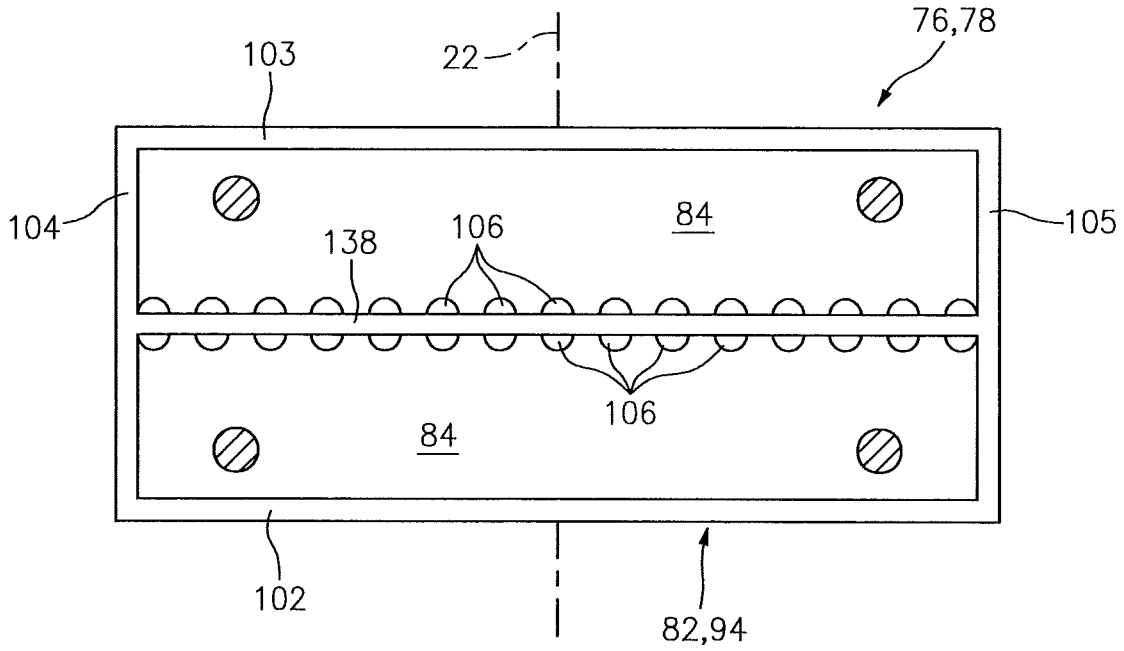
FIG. 14 is a sectional illustration of a portion of an alternate embodiment of a combustor wall.

Referring to FIGS. 13 and 14, one or more of the panels 94 may each include at least one intermediate rail 138. The intermediate rail 138 of FIG. 13 extends axially between and is connected to the rails 102 and 103. The intermediate rail 138 of FIG. 14 extends axially between and is connected to the rails 104 and 105. In this manner, the panels 94 of FIGS. 13 and 14 may each define a plurality of the cooling cavities 84. One or more of the cooling elements 106 may be connected to one or both sides of the intermediate rail 138.

Figure 15:
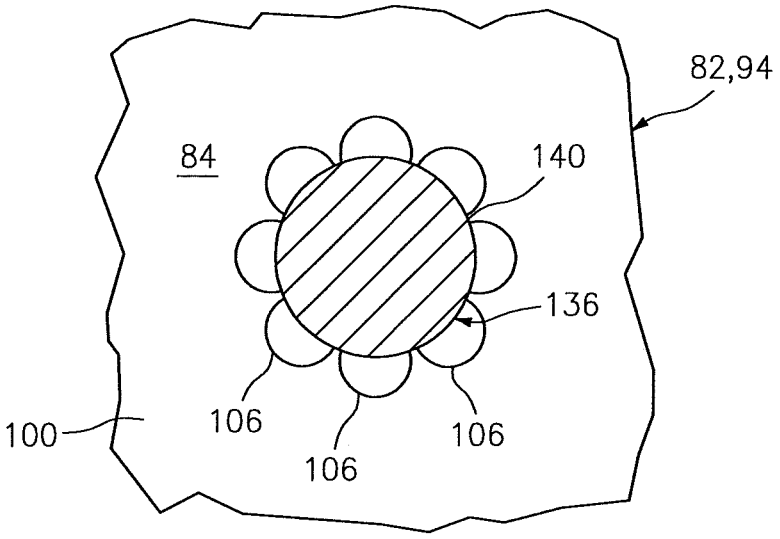
FIG. 15 is a sectional illustration of a portion of an alternate embodiment of a combustor wall.
Figure 16:
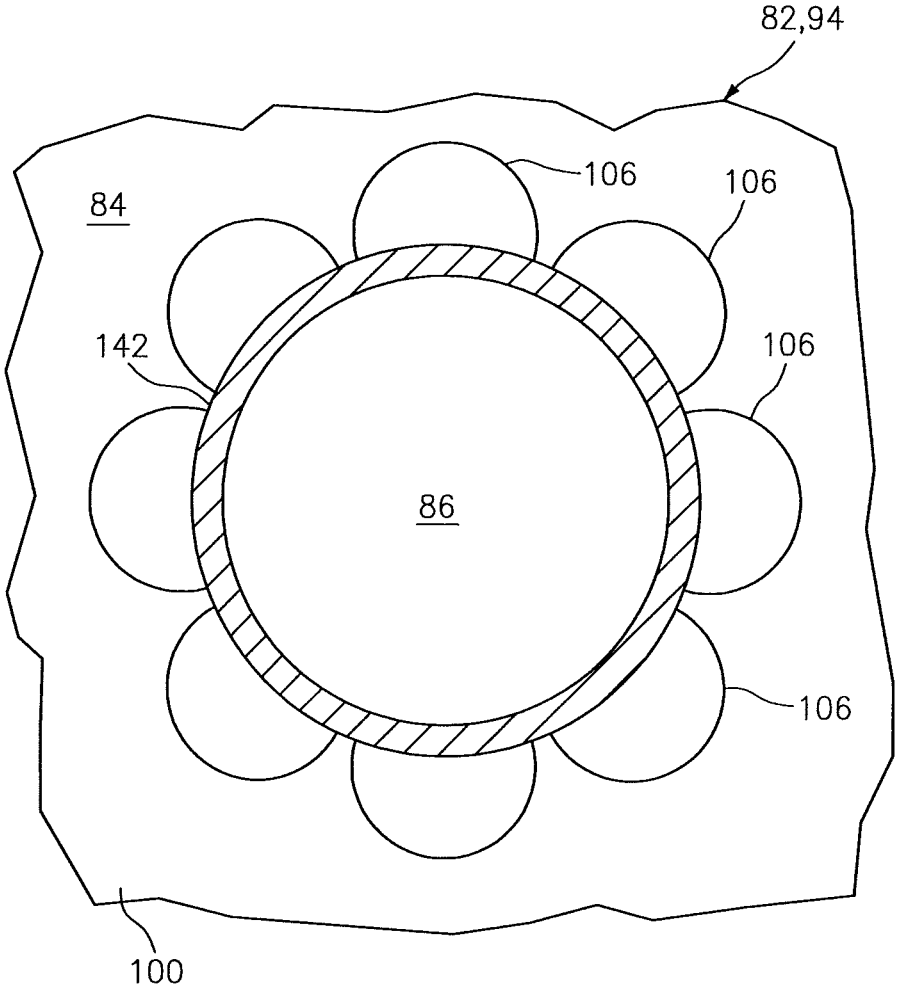
FIG. 16 is a sectional illustration of a portion of an alternate embodiment of a combustor wall.

While the cooling elements 106 are described above as being connected to at least one of the rails 102-105 and/or 138, one or more of the cooling elements 106 may alternatively be connected to one or more other protrusions that extend vertically (e.g., radially) from the panel base 100. For example, referring to FIG. 15, one or more of the cooling elements 106 may be arranged around and connected to a stud 140 of one of the mechanical attachments 136. In another example, referring to FIG. 16, one or more of the cooling elements 106 may be arranged around and connected to a (e.g., annular) boss 142 that, for example, defines one of the quench apertures 86. The present invention, however, is not limited to the foregoing protrusion examples.

In some embodiments, the bulkhead 74 may also or alternatively be configured with a multi-walled structure (e.g., a hollow dual-walled structure) similar to that described above with respect to the inner wall 76 and the outer wall 78. The bulkhead 74, for example, may include a shell and a heat shield with one or more cooling elements 106 as described above with respect to the heat shield 82.

The terms "upstream", "downstream", "inner", "outer", "vertical", "lateral" and "longitudinal" are used to orientate the components of the turbine engine assembly 62 and the combustor 64 described above relative to the turbine engine 20 and its centerline 22. A person of skill in the art will recognize, however, one or more of these components may be utilized in other orientations than those described above. The present invention therefore is not limited to any particular spatial orientations.

The turbine engine assembly 62 may be included in various turbine engines other than the one described above. The turbine engine assembly 62, for example, may be included in a geared turbine engine where a gear train connects one or more shafts to one or more rotors in a fan section, a compressor section and/or any other engine section. Alternatively, the turbine engine assembly 62 may be included in a turbine engine configured without a gear train. The turbine engine assembly 62 may be included in a geared or non-geared turbine engine configured with a single spool, with two spools (e.g., see FIG. 1), or with more than two spools. The turbine engine may be configured as a turbofan engine, a turbojet engine, a propfan engine, or any other type of turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A combustor wall for a turbine engine, the combustor wall comprising:

a shell comprising a shell surface; and a heat shield attached to the shell, the heat shield including a rail and a cooling element connected directly to the rail in a cavity, the cavity extending in a vertical direction between the shell surface and the heat shield, and the cavity fluidly coupling a plurality of apertures in the shell with a plurality of apertures in the heat shield;

wherein the rail has a vertical height and a distal rail end that contacts the shell, and the rail extends in the vertical direction to the distal rail end;

wherein the cooling element has a vertical height that is less than the vertical height of the rail;

wherein the cooling element has a distal end surface that faces and is parallel with the shell surface;

wherein the cooling element extends laterally out from the rail to a distal end;

wherein the cooling element has a length that is between two and three times greater than a width of one of the apertures in the shell; and wherein the length and the width are measured in a direction that is perpendicular to the vertical direction.

2. The combustor wall of claim 1, wherein the vertical height of the cooling element is less than seventy-five percent of the vertical height of the rail.

3. The combustor wall of claim 1, wherein the rail has a thickness;

the cooling element has a thickness that is greater than one hundred percent of the thickness of the rail; and the thicknesses are measured in a direction that is perpendicular to the vertical direction.

4. The combustor wall of claim 1, wherein the heat shield further includes a base; and the rail and the cooling element are connected to the base.

5. The combustor wall of claim 4, wherein the cooling element projects out from a surface of the base to the distal end of the cooling element, and the distal end surface is parallel to the surface of the base.

6. The combustor wall of claim 1, wherein the cooling element is one of a plurality of cooling elements that are arranged along and connected to the rail.

7. The combustor wall of claim 6, wherein the cooling elements include a first element and a second element that is separated from the first element by a gap.

8. The combustor wall of claim 7, wherein one of the apertures in the heat shield is located at the gap.

9. The combustor wall of claim 6, wherein the cooling elements include a first element and a second element that has a different configuration than the first element.

10. The combustor wall of claim 6, wherein the cooling elements include a first element and a second element that has an identical configuration as the first element.

11. The combustor wall of claim 1, wherein the heat shield includes a panel having a downstream end; and the rail and the cooling element are attached to the panel with the rail located at the downstream end.

12. The combustor wall of claim 1, wherein the distal end surface is contiguous with and perpendicular to a surface of the rail.

13. A combustor wall for a turbine engine, the combustor wall comprising:

a shell comprising a shell surface; and a heat shield attached to the shell, the heat shield including a rail and a cooling element connected directly to the rail in a cavity, the cavity extending in a vertical direction between the shell surface and the heat shield, and the cavity fluidly coupling a plurality of apertures in the shell with a plurality of apertures in the heat shield;

wherein the rail has a vertical height and a distal rail end that contacts the shell, and the rail extends in the vertical direction to the distal rail end;

wherein the cooling element has a vertical height that is less than the vertical height of the rail;

wherein the cooling element has a distal end surface that faces and is parallel with the shell surface;

wherein the cooling element extends laterally out from the rail to a distal end;

wherein the cooling element is one of a plurality of cooling elements that are arranged along and connected to the rail; and wherein the cooling elements include a first element and a second element that is contiguous with the first element.

* * * * *